US005527210A

United States Patent [19]

Sharer

[11] Patent Number: 5,527,210

[45] Date of Patent: Jun. 18, 1996

[54] DYNAMIC STEADY REST

[75] Inventor: Rory Sharer, Winnebago, Ill.

[73] Assignee: Woodward Governor Company, Rockford, Ill.

[21] Appl. No.: 245,442

[22] Filed: May 18, 1994

[51] Int. Cl.[6] ..... B24B 3/00

[52] U.S. Cl. ..... 451/408; 451/246; 451/406

[58] Field of Search ..... 451/408, 406, 451/385, 246, 243; 269/254 R, 254 MW

[56] References Cited

U.S. PATENT DOCUMENTS

| | | | |
|---|---|---|---|
| 2,151,660 | 3/1939 | Goehring | 451/26 |
| 2,326,319 | 8/1943 | Bailey | 125/13 |
| 2,413,795 | 1/1947 | Speed | 125/14 |
| 2,567,620 | 9/1951 | Silveh | 451/408 |
| 2,612,014 | 9/1952 | Mathewson | 451/408 |
| 3,145,513 | 8/1964 | Porath | 451/408 |
| 4,276,723 | 7/1981 | Fournier | 451/408 |
| 4,519,279 | 5/1985 | Ruggeri | 451/408 |
| 5,237,780 | 8/1993 | Lessway | 451/408 |

*Primary Examiner*—Bruce M. Kisliuk
*Assistant Examiner*—Andrew Weinberg
*Attorney, Agent, or Firm*—Leydig, Voit & Mayer, Ltd.

[57] ABSTRACT

A dynamic steady rest particularly adapted for use in supporting a rotating workpiece during a grinding operation. The steady rest includes a lever assembly pivotally mounted on a base and having a workpiece support arm and a counterweight arm. Weights are adjustably secured to the counterweight arm and bias the support arm upwardly and into supporting engagement with the rotating workpiece. The steady rest further includes two dashpots pivotally secured between the base and the support arm to dampen the motion of the support arm.

9 Claims, 4 Drawing Sheets

DYNAMIC STEADY REST

BACKGROUND OF THE INVENTION

This invention relates generally to a steady rest for use in conjunction with a machine tool for supporting a rotating cylindrical workpiece and more particularly to a steady rest for use in conjunction with an O.D. grinding machine having a grinding wheel for removing material from the periphery of the workpiece.

As a grinding wheel is advanced and maintained in machining contact with the rotating workpiece, the grinding wheel exerts a relatively high bending force on the workpiece. This force tends to bend the workpiece away from the grinding wheel and induce a high frequency oscillation in the workpiece. Under these conditions, the outside periphery of a finished workpiece that has not been properly supported will be tend to be non-cylindrical and out-of-round. Externally supporting the workpiece on its outside diameter, in a direction generally opposing the force of the grinding wheel, significantly reduces the detrimental bending and high frequency oscillations of the workpiece.

Supporting a rotating workpiece is particularly difficult where, as is often the case in an O.D. grinding operation, the area that must be supported in order to adequately counteract the forces exerted by the grinding wheel is continuously changing in diameter. Prior steady rests require manual adjustment to initially bring a support rod or other support member into supporting contact with the outside diameter of the workpiece. Prior steady rests also require substantially continuous manual re-adjustment of the support rod during machining of the workpiece to maintain support as the diameter of the workpiece decreases. Moreover, these discrete adjustments of the support rod, to support a continuously changing surface, allow detrimental bending and high frequency oscillation of the workpiece during those times when the support rod may not be in intimate contact with the workpiece.

SUMMARY OF THE INVENTION

The general aim of the present invention is to provide a new and improved dynamic steady rest which continuously supports a workpiece during a grinding operation, thereby improving the roundness and cylindricity of the finished workpiece.

A more detailed objective is to provide a dynamic steady rest which automatically adjusts the location of a support rod so that, when the steady rest is supporting the workpiece in the area where material is being removed by the grinding operation, the support rod follows the changing periphery of the workpiece and thereby provides continuous support for the workpiece.

Another detailed objective is to create an adequate and properly directed supporting force to minimize bending and chatter of the workpiece due to the force of the grinding wheel acting on the workpiece.

Still another detailed objective is to provide a support rod whose motion is damped, thereby opposing high frequency chatter of the workpiece.

These and other objects and advantages of the invention will become more apparent from the following detailed description when taken in conjunction with the accompanying drawings.

Figure 1:
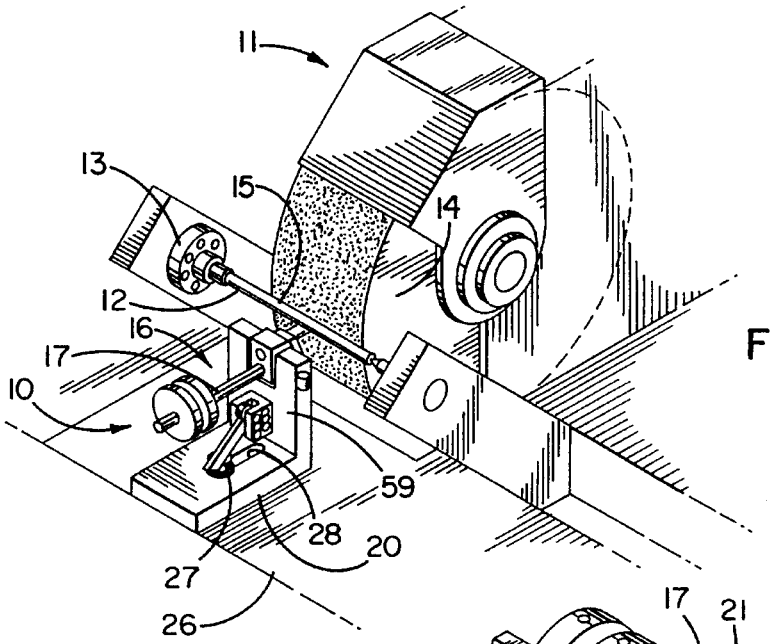
FIG. 1 is a perspective view of a typical machine tool equipped with a new and improved dynamic steady rest incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purpose of illustration, the present invention has been shown in the drawings as embodied in a dynamic steady rest 10 (FIG. 1) for use in conjunction with a machine tool such as a high speed O.D. grinding machine 11. During a grinding operation, an elongated and generally cylindrical workpiece 12 is mounted in a chuck 13 for rotation about its longitudinal axis and in a position for machining engagement by a grinding wheel 14. The grinding wheel typically rotates about an axis that is parallel to the axis of rotation of the workpiece. To effect machining, the grinding wheel is advanced toward and maintained in machining contact with the periphery of the workpiece. Although equally suitable for use with lathes and other machine tools that remove material from a rotating workpiece, the dynamic steady rest is particularly useful during a finish or a rough, or crush, grinding operation where the rate and volume of material removal is relatively high and where the workpiece must often be supported within a machining zone 15, the machining zone being located between the chucked ends of the workpiece and in the area where the grinding wheel engages the workpiece to reduce the diameter thereof.

Figure 2:
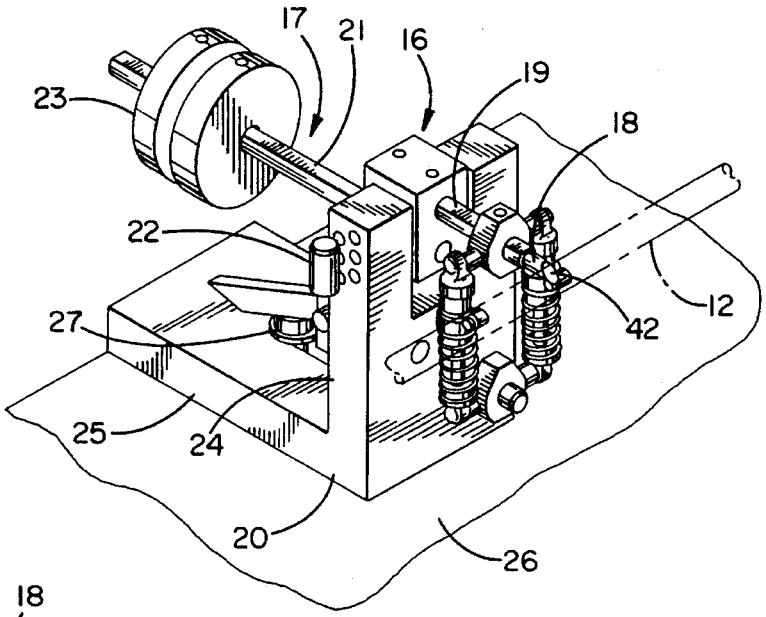
FIG. 2 is an enlarged perspective view of the dynamic steady rest showing a support rod acting on the workpiece.
Figure 5:
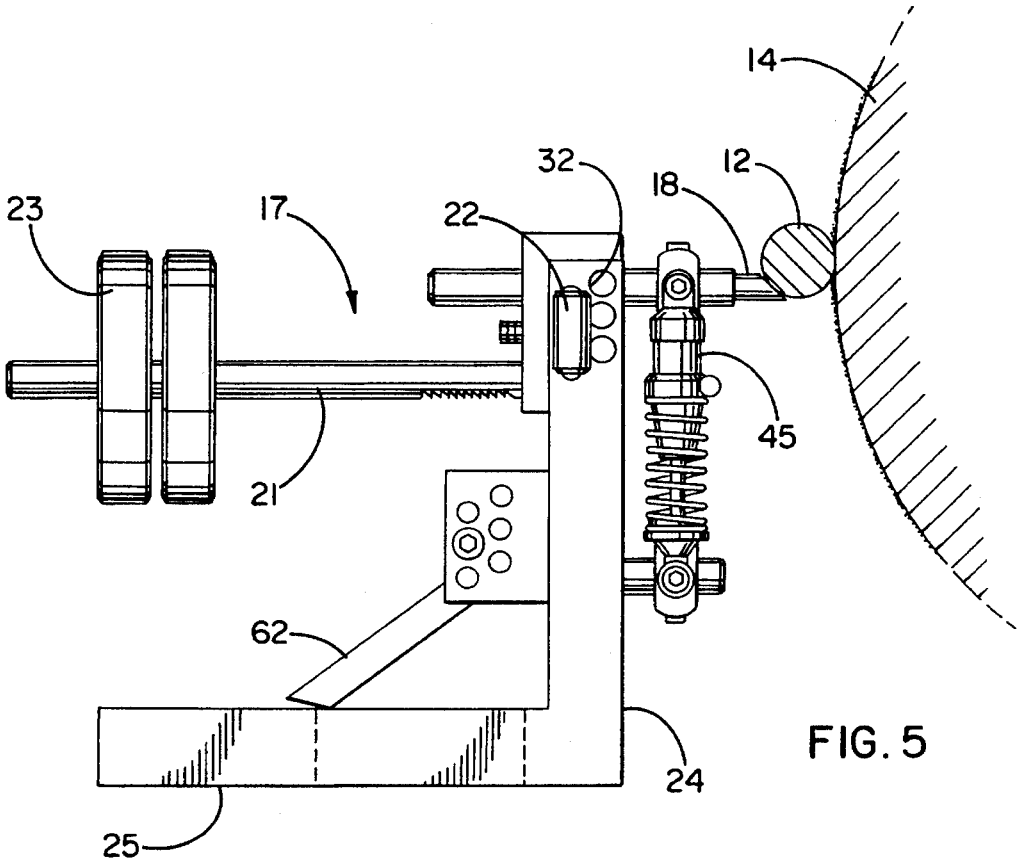
FIG. 5 is an enlarged side view of the dynamic steady rest and shows the support rod in contact with the workpiece during a grinding operation.
Figure 6:
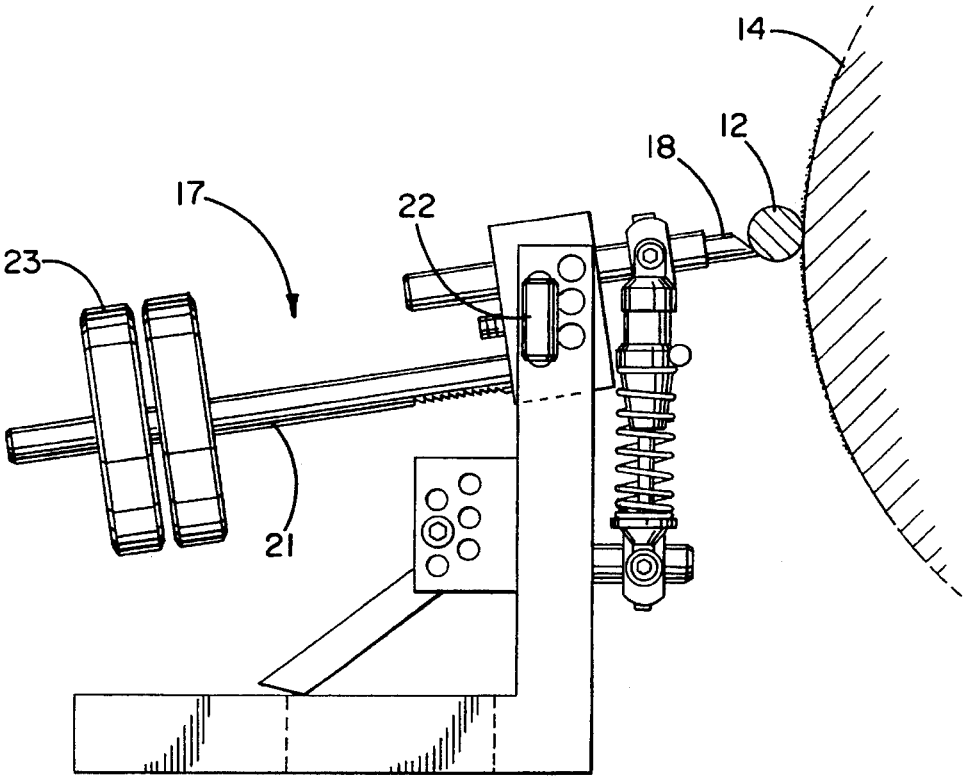
FIG. 6 is a view similar to FIG. 5 but shows the support rod in contact with the workpiece after material has been removed from the workpiece.

The present invention continuously and dynamically supports a rotating workpiece during a machining operation in order to accommodate its changing diameter and thereby reduce the detrimental effects of bending and high frequency oscillations of the workpiece induced by the machining operation. For this purpose, the dynamic steady rest 10 (FIG. 2) comprises a follower mechanism 16 having an elongated lever assembly 17. The follower mechanism allows a support rod 18, preferably made from a carbide material and located at the end of a support arm 19 of the elongated lever, to follow the diameter of the workpiece 12. The elongated lever assembly is pivotally mounted on a fixed support base 20 located between the support arm 19 and a counterweight arm 21 so that the elongated lever pivots upwardly and downwardly about a pivot pin 22. The translation path of the carbide support rod thus is defined by the arc followed by the support rod when pivoted upwardly and downwardly about the pivot pin. During operation, weights 23 secured to the counterweight arm 21 act downwardly to bias the carbide support rod upwardly, thereby maintaining constant contact between the support rod and the changing diameter of the rotating workpiece 12 during the grinding operation as the support rod traverses through its translation path (see FIGS. 5 and 6).

Figure 3:
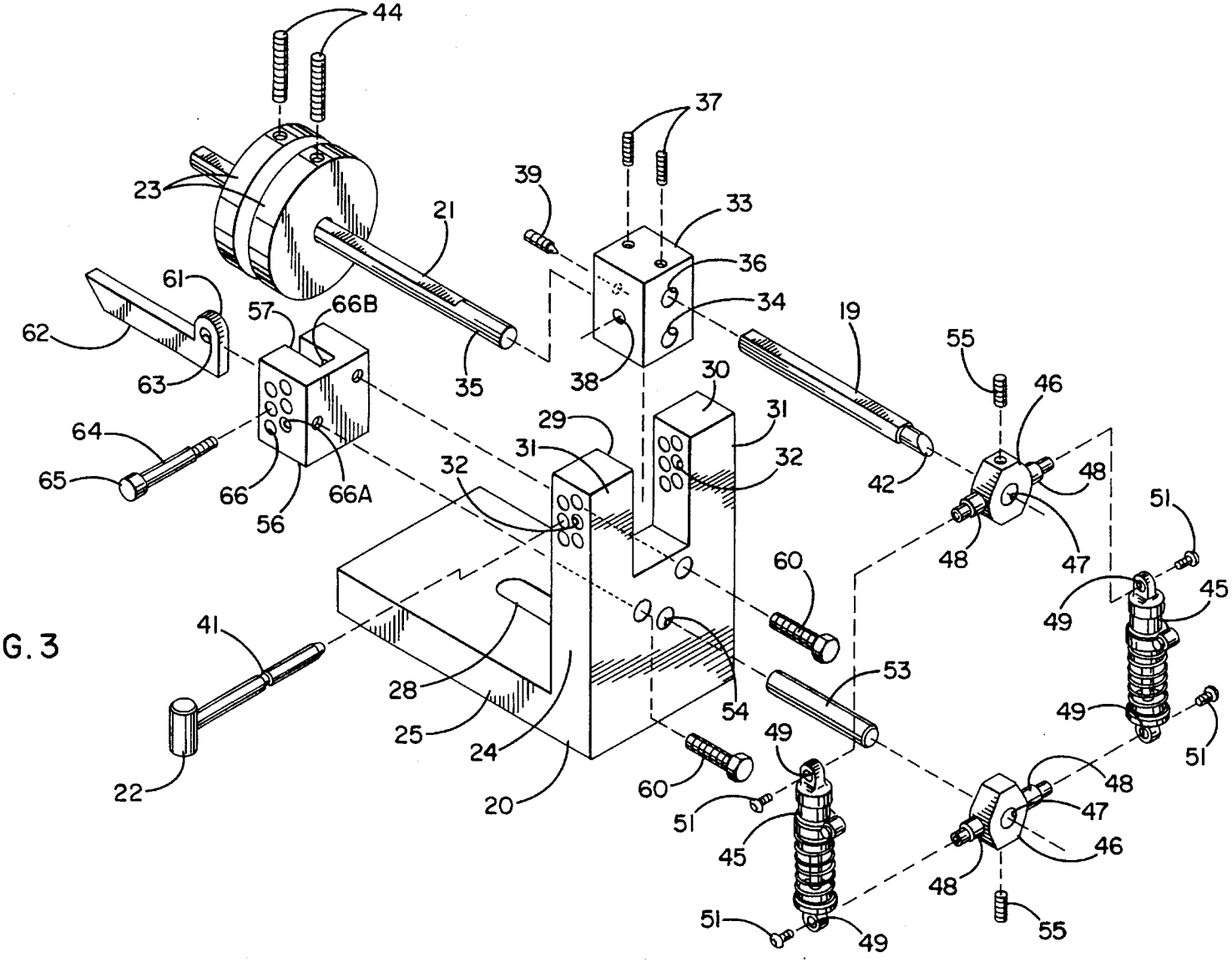
FIG. 3 is an enlarged exploded perspective view of the dynamic steady rest.

More specifically, the base 20 (FIG. 2) of the dynamic steady rest 10 is generally L-shaped, having a vertical portion 24 and a horizontal portion 25 extending from the vertical portion in the direction away from the workpiece 12. The steady rest is secured to a table 26, which is part of the grinding machine 11, by threaded fasteners 27 slidably received in a centrally located slot 28 in the horizontal portion of the base. A second slot 29 (FIG. 3), located in the vertical portion of the base, is open at the center of the upper surface 30 and extends downwardly therefrom, forming two upwardly projecting parallel legs 31 located on either side of the slot. Coaxial pairs of horizontal openings 32, sized to slidably but snugly receive the pivot pin 22, extend through the parallel legs, the axes of the holes being parallel to the axis of rotation of the workpiece.

The elongated lever assembly 17 includes a pivot block 33 as well as the support arm 19 and the counterweight arm 21. An opening 34 in the pivot block securely receives the end portion of the counterweight arm. A second opening 36, parallel to opening 34, in the pivot block slidably receives the support arm. Set screws 37 secure the support arm into the pivot block. A third opening 38 in the pivot block, orthogonal to the openings 34 and 36, is sized to slidably but snugly receive the pivot pin 22. After the arms 19, 21 have been installed, the pivot block is slidably located in the slot 29. The pivot pin is inserted through one of the sets of coaxial openings 32 in the base and through the opening 38 in the pivot block, thereby pivotally mounting the lever assembly on the base 20. A spring loaded plunger 39, threaded into opening 40, axially secures the pivot pin while permitting rotational motion, by engaging a circumferential groove 41 in the pin.

A contact surface 42 (FIG. 2) is formed at the end of the carbide support rod 18 and is defined by a 45 degree beveled end of the rod. During the grinding operation, the contact surface 42 slidably engages and supports the workpiece 12 near the center of the machining zone 15. The weights 23 secured to the counterweight arm 21 produce a substantially constant supporting force between the contact surface and the workpiece. Openings 43 (FIG. 3) in the center of the weights slidably but snugly receive the counterweight arm 21. The location of each weight is adjustable by sliding the weight along the length of the counterweight arm. The weights are secured to the arm by set screws 44. By selecting the number and location of the weights secured to the counterweight arm, the operator can adjust the static force with which the carbide support rod acts on the workpiece so that the force is adequate to oppose the force of the grinding wheel 14 under varying grinding conditions.

Figure 4:
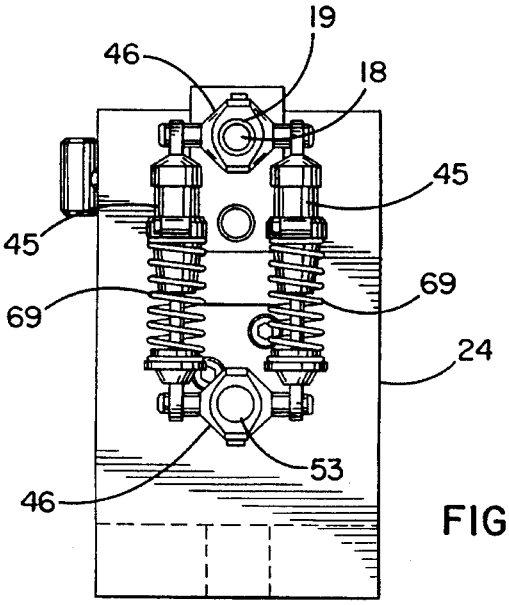
FIG. 4 is an enlarged end view of the dynamic steady rest and shows dashpots joined with and centered about the support rod.

Two dashpots 45 (FIG. 4) are symmetrically located on opposite sides of the carbide support rod 18 and are pivotally secured between the support arm 19 and the vertical portion 24 of the base 20 for damping travel of the carbide support rod. Two pivoting joints 46 (FIG. 3) each have a central opening 47 and two cylindrical trunnions 48, the trunnions projecting outwardly and being located on opposite sides of the opening. Openings 49 in the ends of the dashpots slidably but snugly receive the trunnions. The ends of the dashpots are pivotally retained on the trunnions by screws 51 threaded axially into the trunnions. The central opening 47 in the upper pivoting joint 46 snugly receives the support arm 19. The central opening 47 in the lower pivoting joint 46 snugly receives a horizontal post 53 pressed into an opening 54 in the vertical portion 24 of the base 20, directly below the support arm 19, so that it projects forwardly towards the workpiece. The pivoting joints are secured to the support arm and the post by set screws 55. The dashpots provide for a follower mechanism having a low natural frequency, thereby permitting the support rod to maintain support of the workpiece while opposing the detrimental high frequency oscillations of the workpiece.

A support block 56 (FIG. 3) having two vertical sides and a vertical slot 57 is secured to the back side of the vertical portion 24 of the base 20 by fasteners 60. The pivoting end 61 of a support leg 62, having an opening 63 sized to snugly receive the shank diameter 64 of a shoulder screw 65, fits slidably but snugly into the vertical slot in the support block. Coaxial pairs of horizontal openings 66 extend through the two vertical sides of the support block, the axes of the pairs of the holes being parallel to the axes of the coaxial pairs of holes 32 sized to receive the pivot pin. The holes 66A in one of the vertical sides are sized to slidably but snugly receive the major diameter of the shoulder screw while the holes 66B in the second vertical side are threaded for engagement with the shoulder screw. The support leg 62 is pivotally secured in the slot by the shoulder screw, the screw having been installed into one of the pairs of holes, so that the support leg is pivotable upwardly and downwardly. During the grinding operation, the support leg rests in a downwardly pivoted inactive position on the horizontal base portion 25 of the dynamic steady rest 10 (see FIG. 5).

Figure 7:
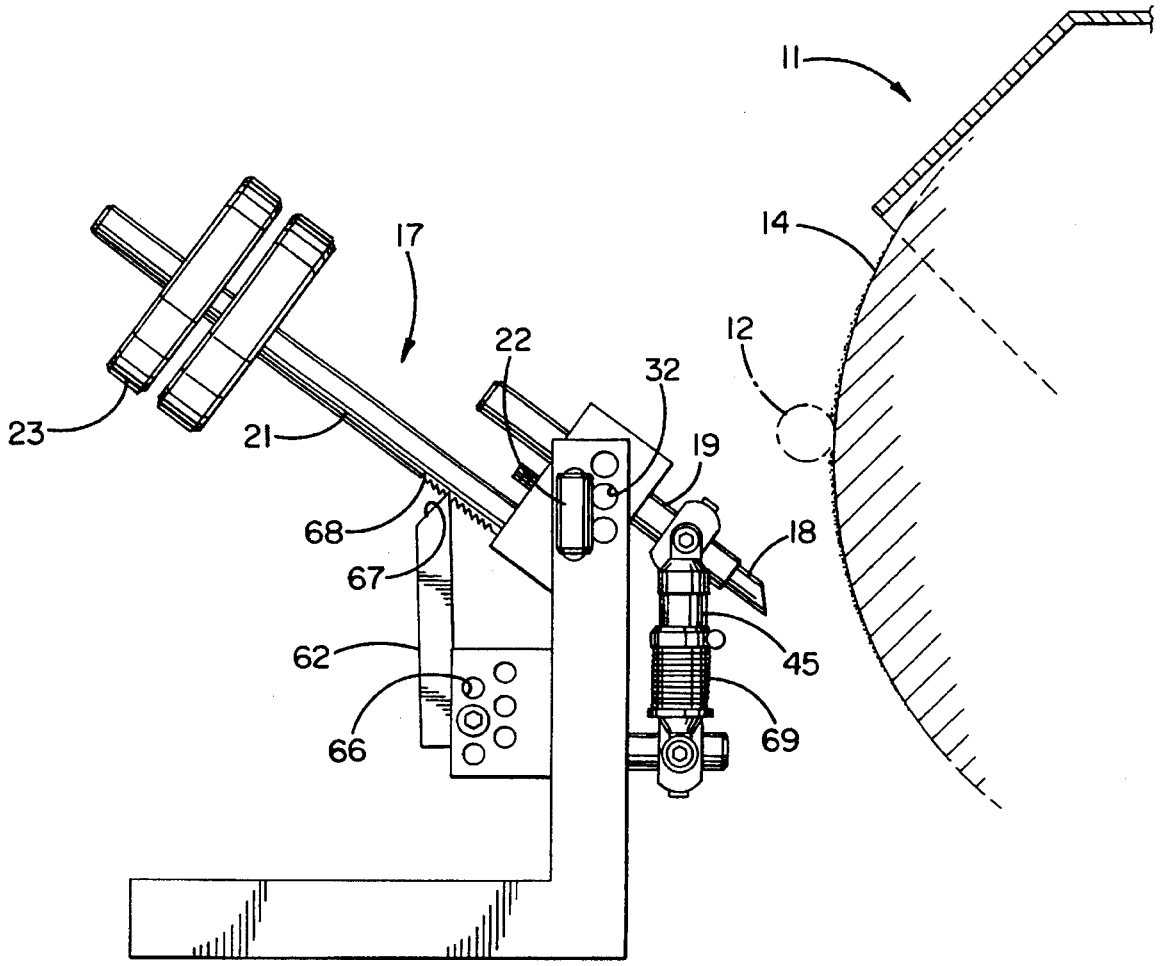
FIG. 7 is an enlarged side view of the dynamic steady rest showing the support rod in a lowered and secured position to facilitate removal and installation of the workpiece.

To provide clearance for loading and unloading a workpiece 12 (FIG. 7) into the grinding machine 11, the carbide support rod 18 may be pivoted downwardly and away from the workpiece area. Manually raising the counterweight arm 21 pivots the carbide support rod downwardly. The second end 67 of the support leg 62 is wedge-shaped. To hold the counterweight arm in the raised position, the wedge end of the support leg is pivoted upwardly, about the shoulder screw 65, and engages one of a series of serrations 68 on the underside of the counterweight arm. Each dashpot 45 is biased to its extended position by a spring 69. These springs impart a relatively low pivoting torque on the elongated lever 17 in order to maintain engagement of the support leg 62 with the serrations in the event that the weights 23 are removed. When a new workpiece is loaded into the grinding machine, the wedge end of the support leg is disengaged from the serrations and the counterweight arm 21 is lowered, thereby enabling the carbide support rod to pivot upwardly into contact with the workpiece.

Advantageously, the support rod 18 may be adjusted to accommodate different size workpieces 12 and different angles of contact between the workpiece and the grinding wheel 14 . The slot 28 (FIG. 3) in the horizontal portion 25 of the base 20 permits forward and rearward adjustment of the dynamic steady rest 10 along the length of the slot. The coaxial pairs of openings 32 in the vertical portion 24 of the base permit adjustment of the elongated lever assembly 17 upwardly, downwardly, forwardly and rearwardly by selectively moving the location of the pivot pin 22. The coaxial pairs of openings 66 for the shoulder screw 65 correspond to the coaxial pairs of openings 32 for the pivot pin to maintain spaced relation between the support leg pivot 61 and the pivot pin. The opening 36 in the pivot block 33 slidably but snugly receives the support arm 19 for fine adjustments of the contact surface 42 of the support rod 18 in the forward and rearward directions. After the final adjustment has been made to the support rod, the support arm 19 is locked into position by the set screws 37. Correct adjustment of the support rod location insures that the translation path of the contact surface follows the changing diameter of the workpiece and that the supporting force is generally directed towards the axis of the workpiece to oppose the force of the grinding wheel 14 on the workpiece.

From the foregoing, it will be apparent that the present invention brings to the art a new and improved steady rest which continuously and dynamically supports a rotating workpiece during a machining operation, thereby reducing detrimental bending and high frequency oscillations of the workpiece. Accordingly, the roundness and cylindricity of the finished workpiece are enhanced.

I claim:

1. A dynamic support for use in a machine tool for supporting a rotating workpiece, in which the workpiece is mounted for rotation about an axis for engagement by a tool in a machining zone such that the tool removes material from the periphery of the workpiece as the workpiece is rotated about its axis, the dynamic support comprising, in combination:

a base for fixedly mounting on the machine tool near the machining zone;

the base carrying a follower mechanism pivotably mounted thereon which terminates in a contact surface, the follower mechanism as it pivots establishing a translation path for the contact surface directed generally toward the axis of the workpiece in the machining zone;

a static load for pivotably loading the follower mechanism to urge the contact surface along the translation path against the rotating workpiece to support the workpiece as material is removed from the surface thereof; and a damper connected to the follower mechanism for damping travel along the translation path so as to allow low frequency follower movement to dynamically maintain support of the workpiece during machining while opposing high frequency motion detrimental to workpiece cylindricity.

2. A dynamic support as set forth in claim 1 wherein the static load is adjustable to set the static force exerted by the contact surface against the rotating workpiece to a level adequate to oppose the forces imposed by the tool against the rotating workpiece.

3. A dynamic support as set forth in claim 2 in which the tool is a high speed grinder, and the range of movement of the contact surface along the translation path is sufficient to support the workpiece with said static force throughout a rough or finish grinding operation.

4. A dynamic support for a machine tool of the type having a chuck for supporting and rotating a workpiece about its axis, and a grinding wheel for engaging the periphery of the rotating workpiece in a machining zone to remove material from the workpiece surface to produce a cylindrically ground part, the dynamic support comprising, in combination:

a base adapted to be fixedly supported on the machine tool near the machining zone;

the base supporting a follower mechanism having a workpiece contact surface at a terminal portion thereof;

the follower mechanism being pivotably supported by the base at a pivot point in such a way that pivoting of the follower serves to translate the contact surface along a translation path generally toward the axis of the workpiece so as to engage the contact surface with the periphery of the workpiece for support thereof;

adjustable loading means for pivotably loading the follower mechanism to set a static force exerted by the contact surface against the workpiece as the contact surface is translated along the translation path to provide a substantially constant support force for supporting the workpiece and preventing deflection thereof by the grinding wheel; and a damper connected to the follower mechanism and supplying a damping characteristic to the pivotable follower which allows the loading means to translate the contact surface to maintain contact with the rotating workpiece as material is removed from the surface thereof while opposing higher frequency workpiece deflection detrimental to workpiece cylindricity.

5. A dynamic support for a workpiece adapted to be rotated about a predetermined axis in machining engagement with a tool for removing material from the periphery of the workpiece, said dynamic support comprising:

a fixed support;

a follower mechanism pivotally secured to the fixed support in spaced relation with the workpiece, the follower mechanism having a support end;

a support surface located on the support end of the follower mechanism and positioned such that, as the support end tends to pivot in one direction, the support surface engages the periphery of the workpiece;

means coacting with the follower mechanism for continuously urging the support surface against the periphery of the workpiece in the area of machining engagement and in a direction generally opposing the direction of engagement by the tool; and a dashpot acting between the follower mechanism and the fixed support and having a damping characteristic which allows low frequency follower pivoting to allow the support surface to engage the workpiece as it is machined, and to damp high frequency motion.

6. A dynamic support as recited in claim 5, wherein said means comprises a plurality of weights coacting with the follower mechanism for urging the support surface against the workpiece.

7. A dynamic support as recited in claim 5, wherein the support surface is made from a carbide material.

8. A machine tool comprising a grinding wheel rotatable about a first generally horizontal axis, means for rotating a workpiece about a second and generally parallel axis, means for feeding said grinding wheel toward said workpiece to cause said wheel to remove material from said workpiece, a fixed support, an elongated lever having first and second end portions and mounted on said support to pivot upwardly and downwardly relative thereto about a third axis located between said end portions and extending generally parallel to said first and second axes, means selectively adjustable along said first end portion of said lever for biasing said second end portion of said lever upwardly about said third axis and into engagement with said workpiece, and means acting between said support and said second end portion of said lever for dampening pivotal motion of said second end portion of said lever about said third axis.

9. A machine tool as defined in claim 8 in which said biasing means comprise a plurality of weights slidably mounted on said second end portion of said lever, and means for releasably securing each of said weights in a fixed position along said second end portion.

* * * * *